United States Patent [19]

Mikol

[11] Patent Number: 4,926,518

[45] Date of Patent: May 22, 1990

[54] PLASTIC DRAIN AUGER

[75] Inventor: Erwin F. Mikol, Park Ridge, Ill.

[73] Assignee: Twentieth Century Companies, Inc., Wheeling, Ill.

[21] Appl. No.: 219,956

[22] Filed: Jul. 15, 1988

[51] Int. Cl.[5] ..... B08B 9/02

[52] U.S. Cl. ..... 15/104.33; 428/371

[58] Field of Search ..... 15/104.33; 428/369–371; 249/59; 267/166

[56] References Cited

U.S. PATENT DOCUMENTS 3,950,934 4/1976 Irwin ..... 15/104.33

4,376,321 3/1983 Dudley ..... 15/104.33

FOREIGN PATENT DOCUMENTS 1055417 3/1986 Japan ..... 267/166

*Primary Examiner*—Edward L. Roberts

*Attorney, Agent, or Firm*—Cook, Egan, McFarron & Manzo, Ltd.

[57] ABSTRACT

A plastic drain auger made from plastic, such as polypropylene or polybutylene, extruded to provide an elongated member having an outward appearance similar to a helical coil. Extrusion of the plastic produces a structure having improved torsional and tensile strength which is essential so the auger can withstand fairly severe forces created as it is pushed and pulled through a drain pipe. The use of a helical coil form for the auger provides the flexibility necessary for the auger to be rotated, twisted and contorted within a drain pipe system.

7 Claims, 1 Drawing Sheet

FIG. 3A

FIG. 1
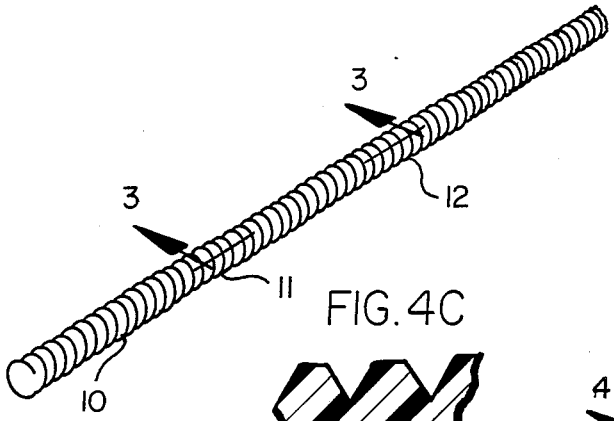
FIG. 2
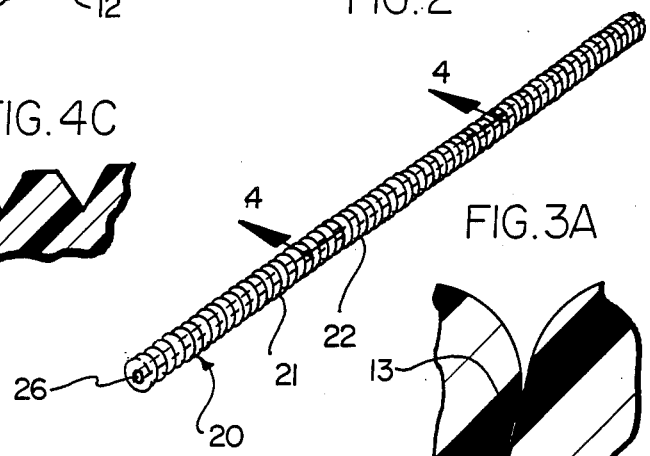
FIG. 4C
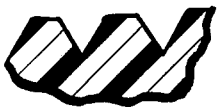
FIG. 4D
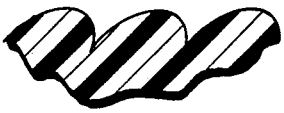
FIG. 3A
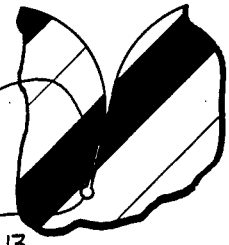
FIG. 3
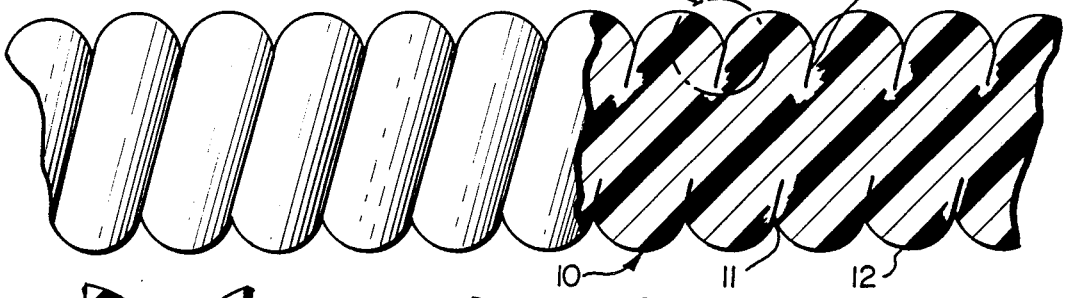
FIG. 4A
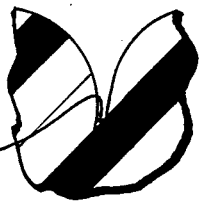
FIG. 4B
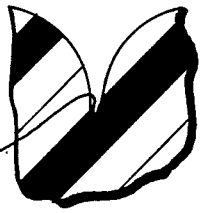
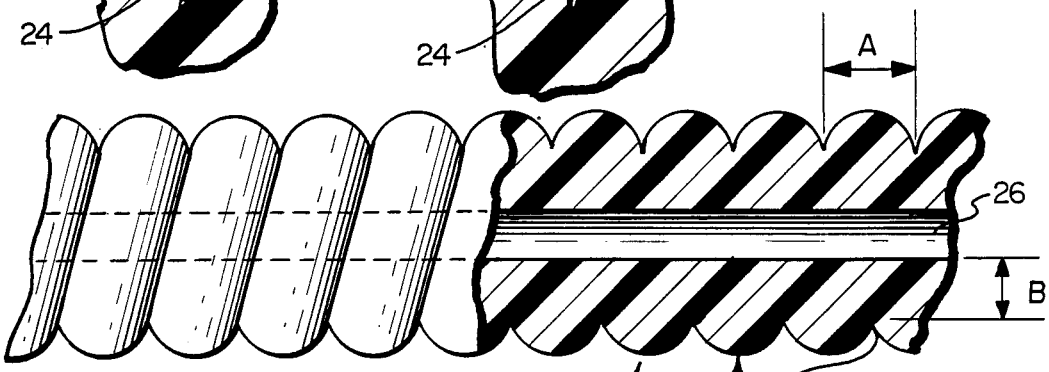
FIG. 4

PLASTIC DRAIN AUGER

BACKGROUND OF THE INVENTION

This invention relates to an elongated auger used to clean out tubes or pipes, such as sink drain pipes, made from a corrosion resistant plastic material.

The drain cleaning augers shown in the prior art are generally constructed from metal, although some are made from either a combination of metal and plastic parts, or metal parts which are coated with plastic such as nylon.

U.S. Pat. No. 4,570,281 discloses the use of a variety of plastic fittings, pieces and couplers used in the design of the housing for a rotary drainer. However, the auger itself used is a conventional plumber's snake made of a helical metal coil. U.S. Pat. No. 4,666,530 discloses a variety of plastic gaskets, washers, spacers and fibrous strands used in a device for cleaning out duct work. U.S. Pat. No. 4,546,519 discloses, in addition to various plastic parts, the use of a tape composed of steel coated with glass-reinforced plastics. The use of nylon in the auger portion of devices used to clean ducts or pipes is disclosed in U.S. Pat. Nos. 4,376,321 and 4,666,530.

Although the prior art discloses a number of devices for cleaning out pipes and tubes which utilize a wide variety of plastic components, the prior art does not disclose augers which are composed entirely from plastic materials. Plastics, because they are non-corrosive, are extremely well suited for use in cleaning out drain lines where all types of waste fluids may be encountered.

The auger of the present invention, which is produced from extruded plastics, is capable of withstanding the rigorous use drain augers typically encounter, yet, they are light weight, corrosion resistant, easy to handle, and relatively inexpensive, compared to their metal counterparts.

SUMMARY OF THE INVENTION

Applicant's invention is directed to a drain auger made from a plastic material, such as polypropylene or polybutylene. The auger of the present invention is extruded to form an elongated shape having the configuration of a helical coil on its outer surface. The interior of the auger is preferably hollow, i.e., cylindrical, although solid augers are contemplated. Extrusion of the plastic in the helical coil shape configuration on its outer surface allows for increased torsional and tensile strength needed to push and pull an auger through a drain system and allows for greater flexibility which permits the auger to follow the contours, twists, and bends present in a drain system. The use of plastic augers in drain cleaning equipment is desirable inasmuch as they are non-corrosive, lightweight and less expensive than their metal counterparts.

Thus, one object of the present invention is to provide an improved pipe cleaning auger made from plastic material which has been extruded in the helical surface configuration in order to provide greater flexibility and relatively high torsional and tensile strength.

Another object of the present invention is to provide an improved pipe cleaning auger made of extruded plastic which has an outer surface shaped to form a helical coil configuration and which, by varying the shape and size of the outer surface of the ribs of the coil, the flexibility of the auger may readily be increased or decreased according to the type of application the auger is intended to be used for.

It is yet another object of the present invention to provide an improved auger made from extruded plastic material having its outer surface shaped to form a helical coil whereby a continuous slit directed radially inwards is formed along the outer surface of the helical coil, and, by varying the depth and/ or width of this notch the flexibility of the auger may be varied in order to suit the intended application or use of the auger.

BRIEF DESCRIPTION OF THE DRAWINGS

FIG. 1 is a perspective view of a portion of the auger of a solid central core embodiment of the invention.

FIG. 2 is a perspective view of a portion of a hollow cylindrical core embodiment of the invention.

FIG. 3 is a transverse section of the auger taken along line 3—3 of FIG. 1.

FIG. 3A is an expanded view of a portion of FIG. 3 showing the inwardly extending radial slit.

FIG. 4 is a transverse section of the auger taken along line 4—4 of FIG. 2.

FIG. 4A is an expanded view of a portion of FIG. 4 showing the one embodiment of the notch; and FIG. 4B is an expanded view of a portion of FIG. 4 showing another embodiment of the notch.

FIG. 4C is a transverse section of a portion of the auger showing the contour of the outer surface of the helical coil as essentially frusto conical.

FIG. 4D is a transverse section of a portion of the auger showing the contour of the outer surface of the helical coil as essentially elliptical.

DESCRIPTION OF THE PREFERRED EMBODIMENTS

Referring to FIGS. 1 and 3, there is illustrated a portion of an auger 20 made from extruded plastic material which has an outer surface shaped in a helical coil form, as shown by ribs 12 which are separated by notches 11. A continuous notch 11 extends helically along the entire length of the auger at its outer surface and is directed radially inwards. This notch allows for greater flexibility of the auger in adopting to contours and bends in the drain system. By varying the depth of notch 11 in the radial direction, the flexibility of the auger may be increased or decreased according to the thickness or diameter of the coil itself and/or the intended application of the auger. Moreover, the number of ribs 12 in the surface of the helix per length of auger, (or distance A, the rib width), can also be varied in order to affect the flexibility of the auger.

As is shown in FIG. 3, notches 11 may be extended by radial slit 13 which extends inwardly from notch 11, i.e., inwardly from the outer surface of the auger toward the axis of the auger. Radial slit 13 provides added flexibility to the auger. The flexibility of the auger can be controlled by adjusting the distance between the axis of the auger and the innermost end 14 of radial slit 13.

In the preferred embodiment, the innermost end 14 of radial slit 13 includes a longitudinal opening 14 as is shown in FIG. 3A. The longitudinal opening, which may be oval in its cross section, prevents radial cracking of the auger at the end of slit 13 as the auger is flexed and as the plastic ages over time.

Outer coil surface of ribs 12 contact the interior surface of a drainpipe, and by rotating the auger manually or with use of a motor, the drainpipe can be scraped free from obstructions and debris buildup. Although a conventional ribbed or spherical shaped outer surface is illustrated in cross section in FIG. 3, other configurations such as elliptical or frustoconical cross sections may be used to effectively scrape clean the interior of a pipe.

Referring now to FIGS. 2 and 4, there is shown a second preferred embodiment of the invention wherein a hollow cylindrical core 26 is used to increase flexibility of the auger. Conversely, a solid cylindrical core as shown in FIGS. 1 and 2 may be used to decrease flexibility of the auger while increasing the strength of the device.

The auger illustrated in FIG. 3 is also made up of notches 21 and ribs 22, which provide for the outer surface of said auger being a helical coil shape, concentrically positioned about the central, hollow axis 26. In the embodiment illustrated by FIG. 4, the inward termination of notch 21 ends in longitudinal space 24. Similar to the configuration shown in FIG. 3, longitudinal space 24, shown in FIG. 4, prevents radial cracking of the notch toward the axis as the auger is flexed and as the plastic used therein ages. The embodiment illustrated in FIG. 4 also contemplates an enlarged notch 24, wherein ribs 22 are spaced apart from one another. Enlarged notch 24 may assume a variety of configurations depending upon the shape of ribs 22 along the outer surface of the auger, be they spherical, frustoconical, etc. Two examples of the configurations which enlarged notch 24 may assume are shown in detail in FIGS. 4A and 4B, although it is anticipated other configurations may be used. Moreover, the radial distance between enlarged notch 24 and core 22 (shown as distance B) may also be increased or decreased to alter the flexibility and strength of the auger.

Also illustrated in FIG. 4 in cross sectional view is the spherical shape of ribs 22 which form the outer surface area of the device. As mentioned above, the cross sectional shape of these ribs may be varied and other cross sectional configurations such as ellipses or frustoconical shapes would be appropriate for scraping the interior surface of pipes or tubes. In the preferred embodiment, the auger would have an outer diameter between ¼ and ½ inch with slits 13 being equal to about ¼ the out side diameter. As an example, an auger having an outer diameter of ¼ inch would have slits 1/16 inch deep, leaving an uninterrupted central core of ⅛ inch in diameter. Alternatively, an auger with a ½ inch outer diameter would have slits approximately ⅛ inch deep, leaving a solid core of about ¼ inch in diameter. The slits should have a minimum width, preferably with a longitudinal opening at the end, as illustrated by FIGS. 3A, 4A and 4B.

The preferred materials for fabrication of the auger are high density polyethylene or polypropylene. The present invention contemplates the use of graphite filled plastics as another material of construction.

The scope of the invention herein shown and described is to be considered only as illustrative. It will be apparent to those skilled in the art that numerous modifications may be made therein without departing from the spirit of the invention or the scope of the appended claims.

I claim:

1. An elongated, generally cylindrical auger disposed about a central axis, said auger adapted to be used for cleaning pipes and tubes, said auger comprising of a plastic material, said auger having a continuous core concentrically positioned about said central axis, the outer surface of said auger being a helical coil shape, concentrically positioned about said central axis, said helical coil shape being defined by closely spaced ribs separated by notches, said ribs being sufficiently close to limit the flexing of said auger.

2. An auger according to claim 1 having a solid cylindrical axial core.

3. An auger according to claims 1 or 2 having a radial slit which extends inwardly, adjacent to said helical coil, from said outer surface towards the axis of said auger.

4. An auger according to claim 3 wherein the interior end of said slit is terminated at a spiral opening around said core.

5. An auger according to claims 1 or 2 wherein the contour of the outer surface of said helical coil shape is essentially spherical in cross section.

6. An auger according to claims 1 or 2 wherein the contour of the outer surface of said helical coil shape is essentially elliptical in cross section.

7. An auger according to claims 1 or 2 wherein the contour of the outer surface of said helical coil shape is essentially frustoconical in cross section.

* * * * *